United States Patent [19]

Lunardi

[11] Patent Number: 4,929,123

[45] Date of Patent: May 29, 1990

[54] METHOD FOR BUILDING LARGE SPAN TUNNELS BY MEANS OF A CELLULAR ARCH

[76] Inventor: Pietro Lunardi, Piazza San Marco, 1, 20121 Milano, Italy

[21] Appl. No.: 320,969

[22] Filed: Mar. 9, 1989

[30] Foreign Application Priority Data

Mar. 16, 1988 [IT] Italy ..... 19807 A/88

[51] Int. Cl.[5] ..... E21D 9/04

[52] U.S. Cl. ..... 405/150; 405/138

[58] Field of Search ..... 405/132, 138, 139, 140, 405/150

[56] References Cited

U.S. PATENT DOCUMENTS

| | | | |
|---|---|---|---|
| 902,973 | 11/1908 | Knudsen | 405/138 |
| 3,597,929 | 8/1971 | Bodine | 405/140 |
| 3,631,680 | 1/1972 | Thomson | 405/139 |
| 3,916,630 | 11/1975 | Arsuaga | 405/139 |
| 4,009,579 | 3/1977 | Patzner | 405/138 |
| 4,365,913 | 12/1982 | Bonvoisin | 405/132 |
| 4,405,260 | 9/1983 | Tsai et al. | 405/138 X |
| 4,422,798 | 12/1983 | Bonvoisin | 405/132 |
| 4,459,064 | 7/1984 | Berset | 405/138 |
| 4,673,218 | 6/1987 | Murakami et al. | 405/138 X |

*Primary Examiner*—Dennis L. Taylor
*Assistant Examiner*—John A. Ricci
*Attorney, Agent, or Firm*—Bucknam and Archer

[57] ABSTRACT

The method comprises the steps of driving into the ground a plurality of adjoining tubes and coupling these tubes by suitable variable interaxis structures for making a monolithic strong covering or cellular arch.

2 Claims, 5 Drawing Sheets

METHOD FOR BUILDING LARGE SPAN TUNNELS BY MEANS OF A CELLULAR ARCH

BACKGROUND OF THE INVENTION

The present invention relates to a method for making large span tunnels.

As is known, tunnels can be classified into the following types: for road communication (road tunnels, railway tunnels, underground railways tunnels or tubes), for hydraulic communication (aqueduct tunnels, sewage tunnels and so on) and mine tunnels or galleries.

Depending on their cross-section size, these tunnels can be further classified as small, large or very large, the most frequently used tunnel shapes being the circular and polycentric shapes for tunnels in general and rectangular shape for artificial tunnels or galleries.

The excavation can be started starting from either one or the other end of the tunnel path, or, for great length tunnels, intermediate excavation starting points may be provided, through excavation wells or windows, the excavation front advancing occurring simultaneously with the excavation and removal of the rock and building of the temporary or permanent lining.

Several excavation methods have been designed, of the so called alternating sample type; one of this method, the so-called Belgian excavation method, provides for starting excavation with a cap tunnel, which is progressively enlarged in order to coat the tunnel vault. Then there is excavated the central portion of the tunnel neck, in order to cast the tunnel piers.

In the German method, on the contrary, there are at the start excavated side tunnels, in order to cast both the piers; then there are successively made: a cap stable pit, the vault and the excavation of the rock central portion, at the end of the coating or lining operation.

A further excavation method is the so-called Italian method which comprises the steps of excavating at first starting from the tunnel neck in order to form the piers and the reverse arch and enlarging the already excavated tunnel in order to cast the remaining portion of the piers and the vault.

These known methods, however, have the drawback that they have been specifically provided for particular types of rocks: the belgian method for slightly fractured rocks, the german method for poor mechanical characteristic rocks and the italian method for very poor mechanical characteristics rocks.

Another drawback of these methods is that they do not afford the possibility of using the most recent and advanced excavation means and machines, these methods requiring moreover that reinforcing ribs and anchoring means be used, together with armoring nets and reinforced concrete.

Moreover, in the case of the excavation of large span tunnels, the ground must be preliminary consolidated for example by injection and freezing means.

SUMMARY OF THE INVENTION

Accordingly, the main object of the present invention is to overcome the above mentioned drawbacks, by providing such a method for building large span tunnels, through poor mechanical characteristics rocks, which affords the possibility of making both road communication tunnels and channel and sewage tunnels or galleries.

Another object of the present invention is to provide such a method which affords the possibility of excavating tunnels with a very high speed and a low power consumption.

Another object of the present invention is to provide a tunnel making method affording the possibility of carrying out an alternating sample lining or coating operation, instead of a single operation, likewise to the above mentioned three methods, without the need of installing expensive armoring structures.

According to one aspect of the present invention the above objects, as well as yet other objects, which will become more apparent hereinafter, are achieved by a method for making large span tunnels, characterized in that said method comprises the step of driving into the ground, with simultaneous removal of said ground, a plurality of adjoining tubes and coupling said tubes by suitable variable interaxis structures (such as reinforced concrete ribs) for making a strong monolithic cover, or cellular arch.

BRIEF DESCRIPTION OF THE DRAWINGS

Further characteristics and advantages of the invention will become more apparent hereinafter from the following detailed description of a preferred, though not exclusive, embodiment of the subject method for making tunnels, which is illustrated, by way of an indicative but not limitative example, in the figures of the accompanying drawings, where.

DESCRIPTION OF THE PREFERRED EMBODIMENT

Figure 1:
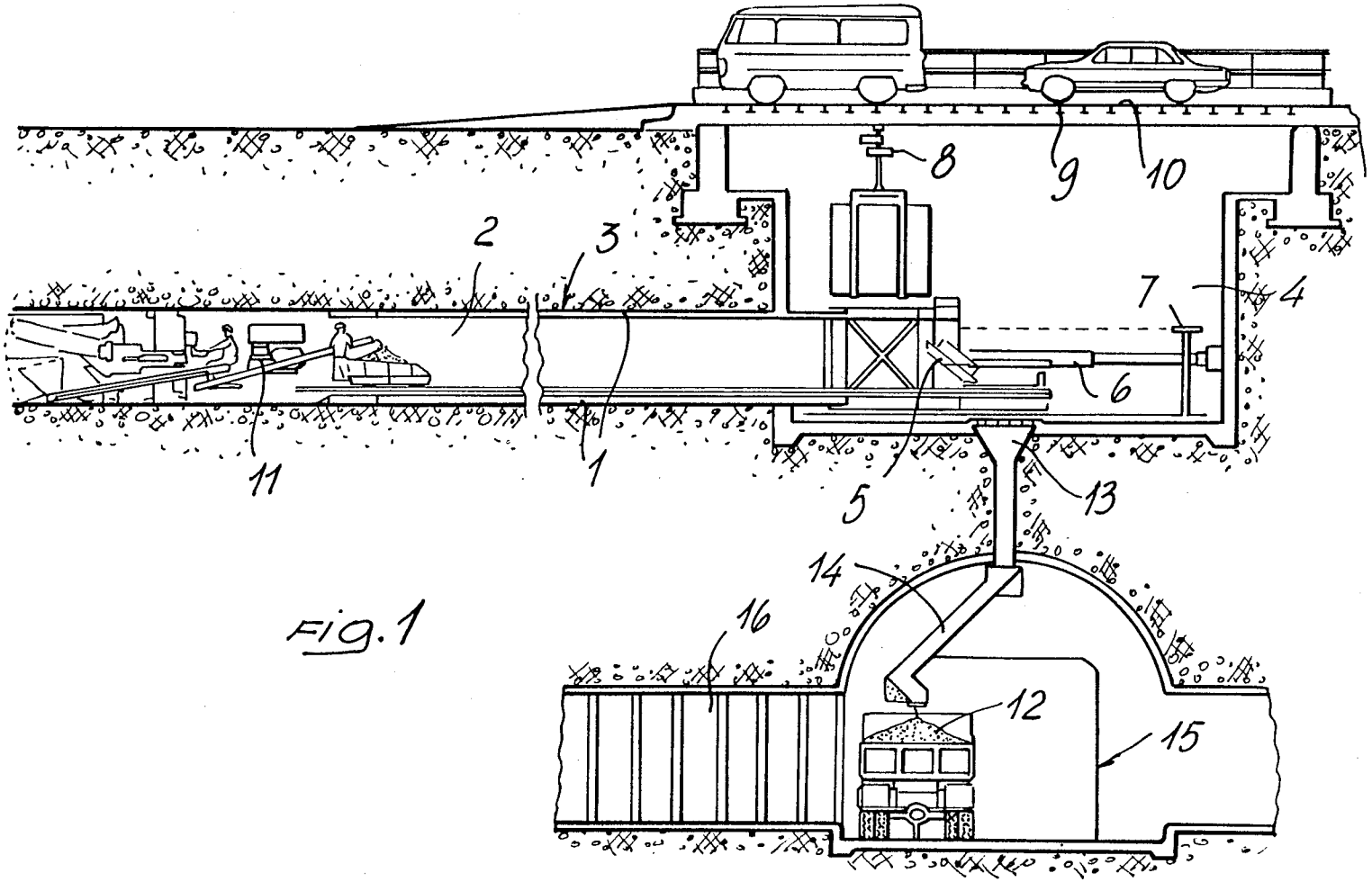
FIG. 1 is a vertical cross-sectional view of a tunnel in which there are installed cap tubes by the method according to the invention.
Figure 2:
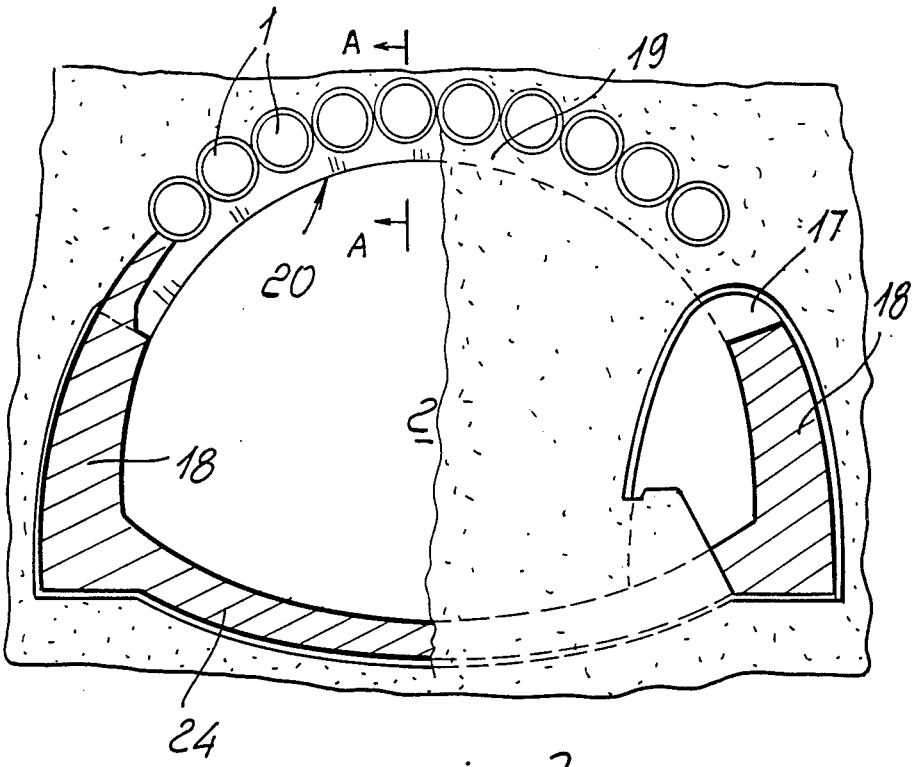
FIG. 2 is a vertical cross-section view illustrating the tunnel being made.
Figure 3:
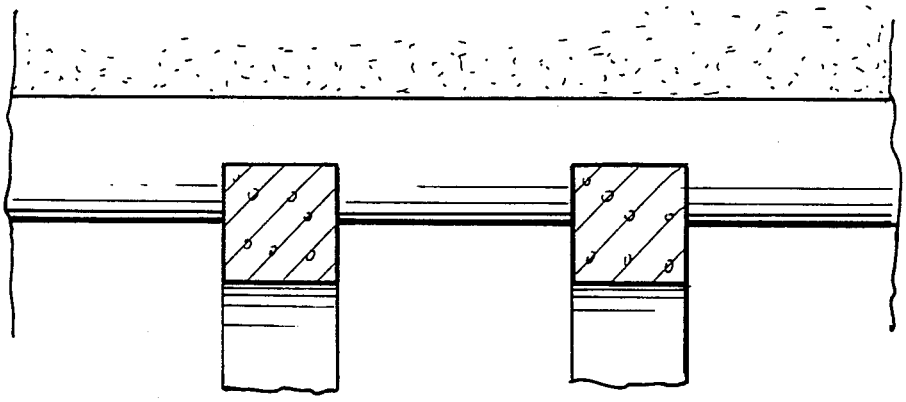
FIG. 3 is a longitudinal cross-section view of the tunnel taken along the line A—A of FIG. 2.
Figure 4:
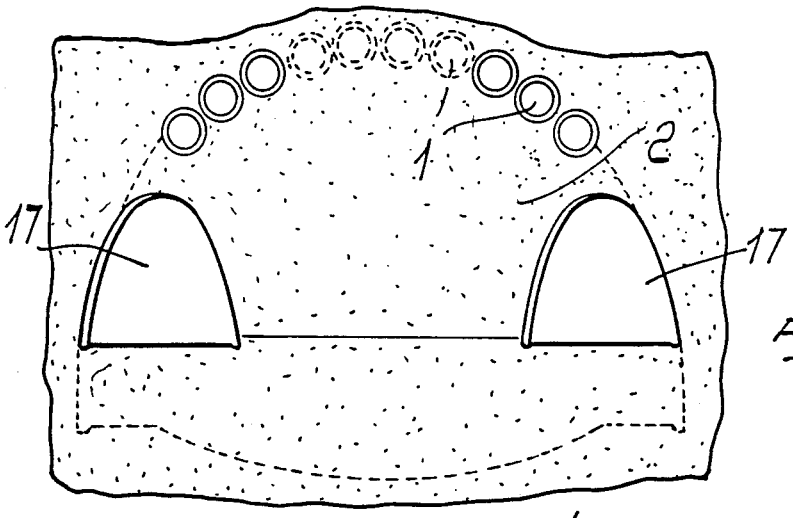
FIG. 4 is a schematic cross-section view illustrating the first operating step for making a tunnel or gallery by the method according to the present invention.
Figure 5:
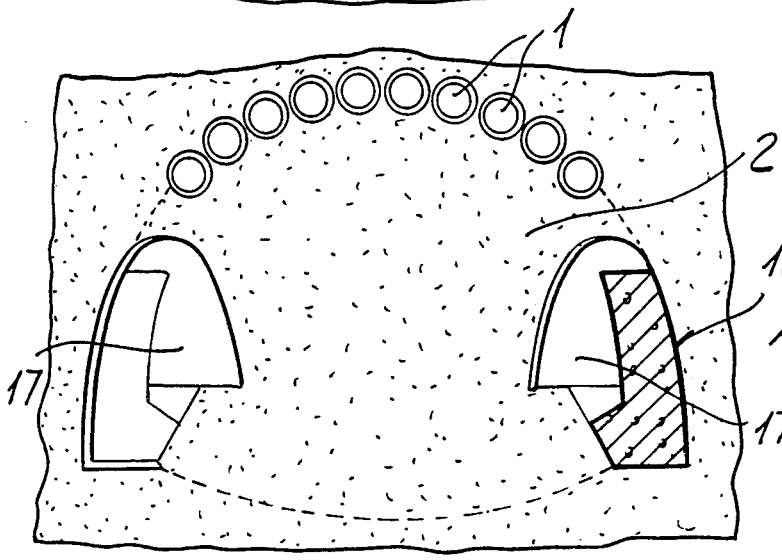
FIGS. 5, 6, 7, 8, 9, 10, 11, 12 are further schematic cross-section view illustrating respectively the second, third, fourth, fifth, sixth, seventh, eighth and nineth operating step for making a tunnel by the method according to the present invention.
Figure 6:
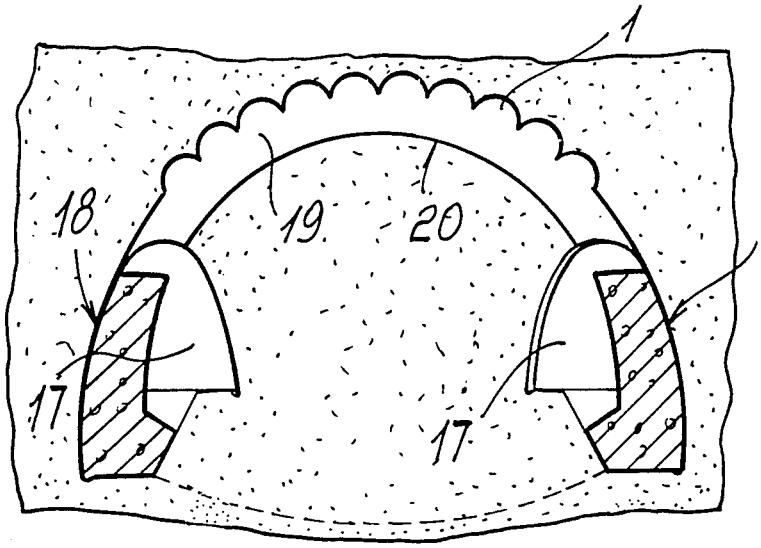
Figure 7:
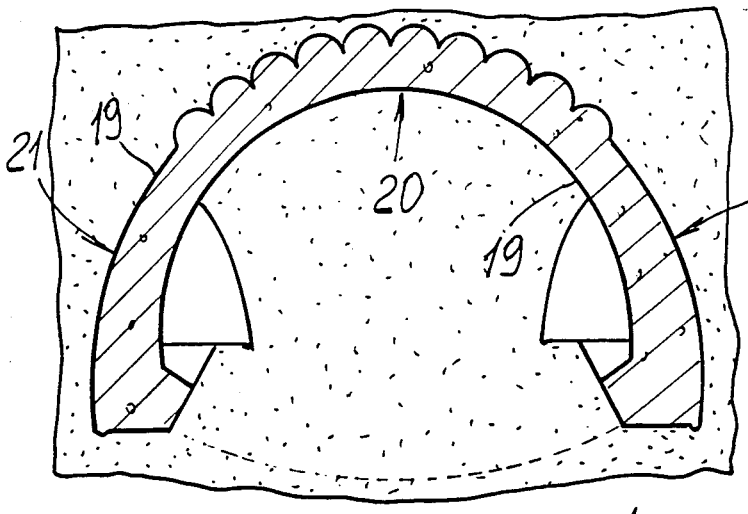
Figure 8:
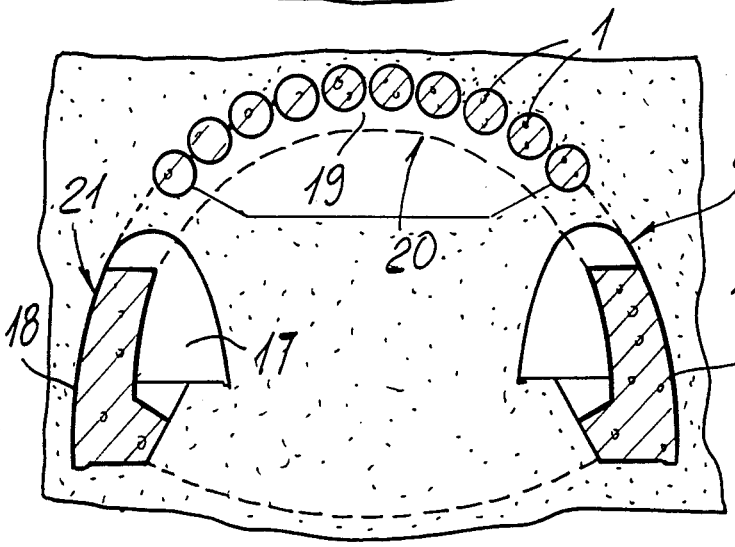
Figure 9:
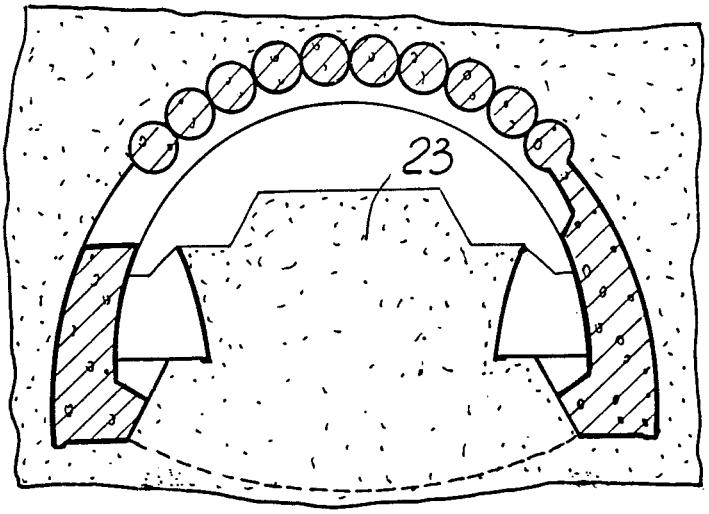
Figure 10:
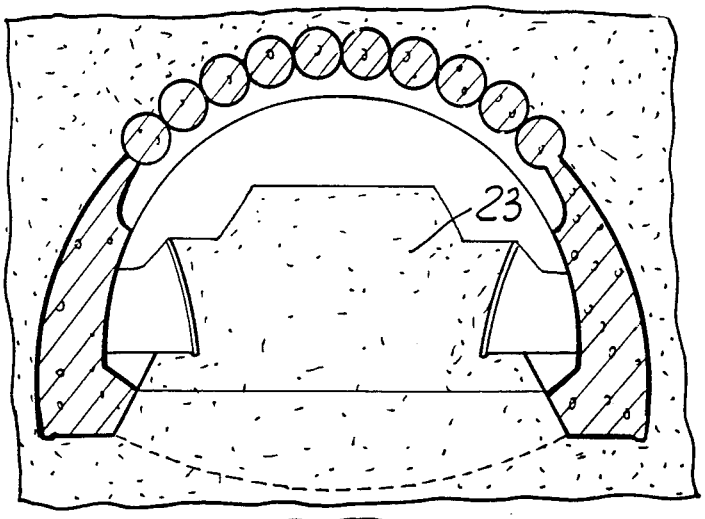
Figure 11:
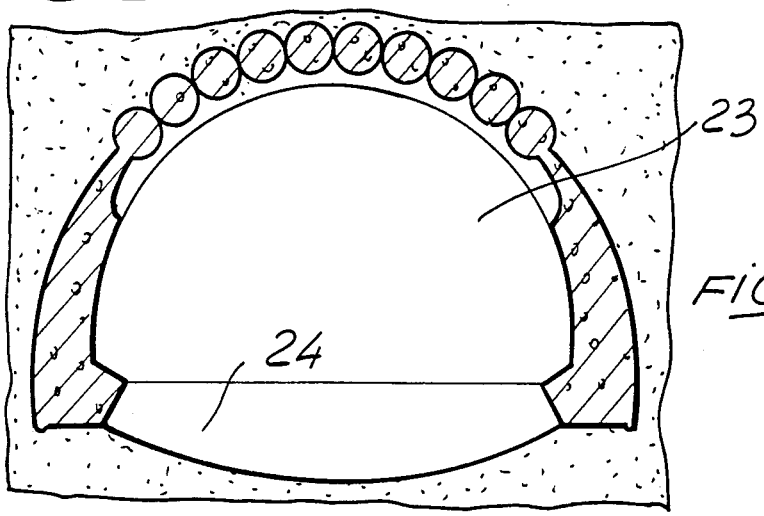
Figure 12:
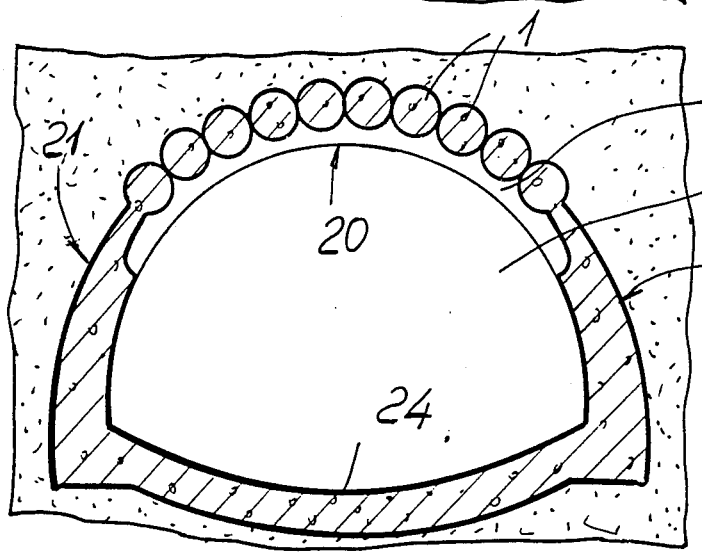

With reference to the figures of the accompanying drawings, the method for making large span tunnels according to the present invention, comprises the step of driving tubes 1 (made of centrifuged reinforced concrete, natural or synthetic fibres or steel)—arranged with an adjoining relationship—into the ground, while simultaneously removing the ground material.

This driving is carried out in parallel with respect to the axis of the tunnel 2, along the upper perimeter 3 thereof.

The tubes 1 are driven from a well 4, formed transversely of the tunnel 2 and in which there is provided a pushing equipment 5, controlled by a hydraulic controlling unit 6, consisting, for example, of a plurality of jacks, the stroke of which is controlled by a laser apparatus 7.

More specifically, the tubes 1 are arranged on the mentioned equipment preferably by means of a hoist 8 adapted to be displaced, as is shown in FIG. 1, along a double T shaped beam 9, which supports the road frame 10.

Inside the tunnel 2 an excavation tool 11 operates allowing a continuous type of advancement, (for example a point or full cross section mill), with a rather high speed.

The removal of the excavated material is carried through a continuous type of loading performed by interposing, between the tool 11 and the transport means 12, a hopper 13 and a conveyor 14.

The loading station 15 is arranged in the tunnel and therefrom one or more pre-advancement channels 16 extend.

The method according to the present invention can be diagrammatically represented by a plurality of steps which are shown in the accompanying drawings.

Before driving the tubes 1, two channels 17 are excavated at the piers 18 of the top vault 19 to be made, in parallel relationship with respect to the axis of the tunnel 2 being made.

In the second step, after having completely driven into the ground the tubes 1, as disclosed hereinabove, at the cap 20 of the tunnel 2, the excavation of the channels 17 is lowered and there are cast the piers 18.

During the following third and fourth steps, there are excavated the bearing arch members (reinforced concrete ribs), 19, and there is completed the casting of said ribs and tubes 1, so as to mutually connect said tubes.

During the following fifth and sixth steps, there are excavated the cap 20 and its sides 21 and there are cast the shoulders 22 between the bearing arches 19.

Then, during the seventh, eighth and ninth steps there are excavated the tunnel neck 23, or body 23 of the tunnel 2, and the reverse arch 24 and then there is cast the arch 24 itself so as to provide the tunnel armoring structure consisting of a grating, either flat or tridimensional, of longitudinal tubular elements and variable interaxis transversal arches.

From the above disclosure, it should be apparent that the invention fully achieves the intended objects.

In particular, the fact is to be pointed out that the subject method affords the possibility of making large span (15 to 50 m) tunnels in loose terrains, with a continuous and high speed removal of the excavated terrain.

While the invention has been disclosed and illustrated with reference to a preferred embodiment thereof, it should be apparent that the disclosed embodiment is susceptible to several modifications and variations all of which will come within the spirit and scope of the appended claims.

I claim:

1. A method for making large span tunnels through a ground formation, comprising the steps of excavating two channels at pier members of a top vault to be made, driving into said ground formation a plurality of adjoining tubes in parallel with a longitudinal axis of a tunnel to be made, said adjoining tubes being driven from a well formed transversely of said tunnel, further excavating said two channels at bottom portions thereof and casting therein said pier members, excavating bearing arch members and casting concrete around said tubes to interconnect said tubes, excavating a tunnel neck portion and a reverse arch and casting said reverse arch.

2. A method according to claim 1, comprising a further step of continuously removing excavated material by providing in said tunnel at least an excavated material loading station, excavating from said loading station at least a pre-advancement channel and arranging in said loading station, between excavating means and excavated material shipping means, excavated material collecting means and, downstream of said collecting means, collected excavated material conveyor means.

* * * * *